US009704662B2

(12) United States Patent
Mantua et al.

(10) Patent No.: US 9,704,662 B2
(45) Date of Patent: Jul. 11, 2017

(54) SWITCH SYSTEM WITH HIGH TEMPERATURE OPERATING PLUNGER

(71) Applicant: HONEYWELL INTERNATIONAL INC., Morristown, NJ (US)

(72) Inventors: Mark A. Mantua, Freeport, IL (US); Jeff Hall, Winnebago, IL (US); Darryl Ballard, Barnardsville, NC (US)

(73) Assignee: Honeywell International Inc., Morris Plains, NJ (US)

( * ) Notice: Subject to any disclaimer, the term of this patent is extended or adjusted under 35 U.S.C. 154(b) by 77 days.

(21) Appl. No.: 14/066,226

(22) Filed: Oct. 29, 2013

(65) Prior Publication Data

US 2015/0114812 A1 Apr. 30, 2015

(51) Int. Cl.

| | |
|---|---|
| ***H01H 5/00*** | (2006.01) |
| ***H01H 5/28*** | (2006.01) |
| *H01H 3/12* | (2006.01) |
| *H01H 9/52* | (2006.01) |

(52) U.S. Cl.

CPC ..... *H01H 5/28* (2013.01); *H01H 3/12* (2013.01); *H01H 9/52* (2013.01)

(58) Field of Classification Search

CPC ..... H01H 1/2015; H01H 3/46; H01H 5/00; H01H 5/12; H01H 5/18; H01H 5/20; H01H 2001/0005; H01H 1/36; H01H 15/18; H01H 65/30; H01H 15/20; H01H 5/22; H01H 5/26; H01H 5/28; H01H 5/30; H01H 13/50; H01H 13/52; H01H 13/54

USPC ..... 200/447, 405, 16 R, 16 B, 16 C, 16 F, 200/48 KB, 400, 434, 439, 537–540, 554, 200/254, 530, 43.04; 337/14, 15, 23, 77, 337/89, 102, 141, 182, 298, 300, 324, 337/377, 390

See application file for complete search history.

(56) References Cited

U.S. PATENT DOCUMENTS

| | | | | |
|---|---|---|---|---|
| 2,840,657 | A * | 6/1958 | Roeser | 200/448 |
| 3,691,333 | A * | 9/1972 | Elliot | H01H 13/56 200/526 |
| 3,959,615 | A * | 5/1976 | Zaffrann, Jr. | H01H 11/0006 200/335 |
| 5,017,747 | A * | 5/1991 | Nagahara et al. | 200/453 |
| 5,621,373 | A | 4/1997 | McCormick | |
| 5,748,066 | A | 5/1998 | Holt | |

(Continued)

*Primary Examiner* — Anthony R. Jimenez
(74) *Attorney, Agent, or Firm* — Conley Rose, P.C.; Kristin Jordan Harkins

(57) ABSTRACT

A switch system includes a snap action switch, an operating plunger, and an actuator. The snap action switch is configured to move, with snap-action, from a first switch position to a second switch position. The operating plunger is disposed adjacent to the snap action switch and is coupled to selectively receive an actuating force. The operating plunger is configured, upon receipt of the actuating force, to retain the snap action switch in the first switch position. The operating plunger is further configured, upon removal of the actuating force, to allow the switch to move from the first switch position to the second switch position. The actuator contacts the operating plunger and is configured to selectively supply the actuating force to, and remove the actuating force from, the operating plunger. The operating plunger comprises a dielectric material having low thermal conductivity.

20 Claims, 2 Drawing Sheets

(56) References Cited

U.S. PATENT DOCUMENTS

| | | | | |
|---|---|---|---|---|
| 5,950,811 | A * | 9/1999 | Kautz | H01H 71/10 200/407 |
| 6,078,246 | A * | 6/2000 | Davis | H01H 37/04 29/622 |
| 6,133,818 | A | 10/2000 | Hsieh et al. | |
| 6,747,541 | B1 | 6/2004 | Holt et al. | |
| 2010/0231347 | A1 | 9/2010 | Knab et al. | |
| 2012/0293294 | A1 | 11/2012 | Baghdasarian | |
| 2013/0032458 | A1 * | 2/2013 | Anderst | 200/345 |

* cited by examiner

SWITCH SYSTEM WITH HIGH TEMPERATURE OPERATING PLUNGER

TECHNICAL FIELD

The present invention generally relates to switches, and more particularly relates to a switch system that includes a high temperature switch operating plunger.

BACKGROUND

Electrical switches are used in myriad systems and environments, and typically operate to open and close an electrical circuit by moving one or more contacts between contact positions. Although electrical switches vary in configuration, one particular type of switch that is relatively popular is a snap action switch. A snap action switch is configured, in response to application and removal of an actuation force, to move, with snap-action, between contact positions.

Snap action switches are fairly robust, reliable, and relatively inexpensive. However, these types of switches are typically not manufactured to be activated by extremely hot actuators. Thus, snap action switches may be prohibited from use in systems which may actuate the using to relatively high temperature methods. This can result in designers using relatively expensive switches in such systems, which can increase overall system costs.

Hence, there is a need for a snap action switch that can be used in systems which may actuate the switch using relatively high temperature methods. The present invention addresses at least this need.

BRIEF SUMMARY

In one embodiment, a switch system includes a snap action switch, an operating plunger, and an actuator. The snap action switch is configured to move, with snap-action, from a first switch position to a second switch position. The operating plunger is disposed adjacent to the snap action switch and is coupled to selectively receive an actuating force. The operating plunger is configured, upon receipt of the actuating force, to retain the snap action switch in the first switch position. The operating plunger is further configured, upon removal of the actuating force, to allow the switch to move from the first switch position to the second switch position. The actuator contacts the operating plunger and is configured to selectively supply the actuating force to, and remove the actuating force from, the operating plunger. The operating plunger comprises a dielectric material having low thermal conductivity.

In another embodiment, a switch system includes a housing, a snap action switch, an operating plunger, and an actuator. The snap action switch is disposed within the housing and is configured to move, with snap-action, between a first switch position to a second switch position. The operating plunger extends through an opening in the housing and contacts the snap action switch. The operating plunger is coupled to selectively receive an actuating force and is configured, upon receipt of the actuating force, to move the snap action switch to and retain the snap action switch in the first switch position. The operating plunger further is configured, upon removal of the actuating force, to allow the switch to move from the first switch position to the second switch position. The actuator contacts the operating plunger and is configured to selectively supply the actuating force to, and remove the actuating force from, the operating plunger. The operating plunger comprises a dielectric material having low thermal conductivity.

In yet another embodiment, a switch system includes a snap action switch, an operating plunger, and a heated actuator. The snap action switch is configured to move, with snap-action, between an open switch position to a closed switch position. The operating plunger extends through an opening in the housing and contacts the snap action switch. The operating plunger is coupled to selectively receive an actuating force and is configured, upon receipt of the actuating force, to move the snap action switch to and retain the snap action switch in the open switch position. The operating plunger is further configured, upon removal of the actuating force, to allow the switch to move from the open switch position to the closed switch position. The heated actuator contacts the operating plunger and is configured to selectively supply the actuating force to, and remove the actuating force from, the operating plunger. The operating plunger comprises a dielectric material having low thermal conductivity.

Furthermore, other desirable features and characteristics of the switch system will become apparent from the subsequent detailed description and the appended claims, taken in conjunction with the accompanying drawings and the preceding background.

BRIEF DESCRIPTION OF THE DRAWINGS

The present invention will hereinafter be described in conjunction with the following drawing figures, wherein like numerals denote like elements, and wherein.

DETAILED DESCRIPTION

The following detailed description is merely exemplary in nature and is not intended to limit the invention or the application and uses of the invention. As used herein, the word "exemplary" means "serving as an example, instance, or illustration." Thus, any embodiment described herein as "exemplary" is not necessarily to be construed as preferred or advantageous over other embodiments. All of the embodiments described herein are exemplary embodiments provided to enable persons skilled in the art to make or use the invention and not to limit the scope of the invention which is defined by the claims. Furthermore, there is no intention to be bound by any expressed or implied theory presented in the preceding technical field, background, brief summary, or the following detailed description.

Figure 1A:
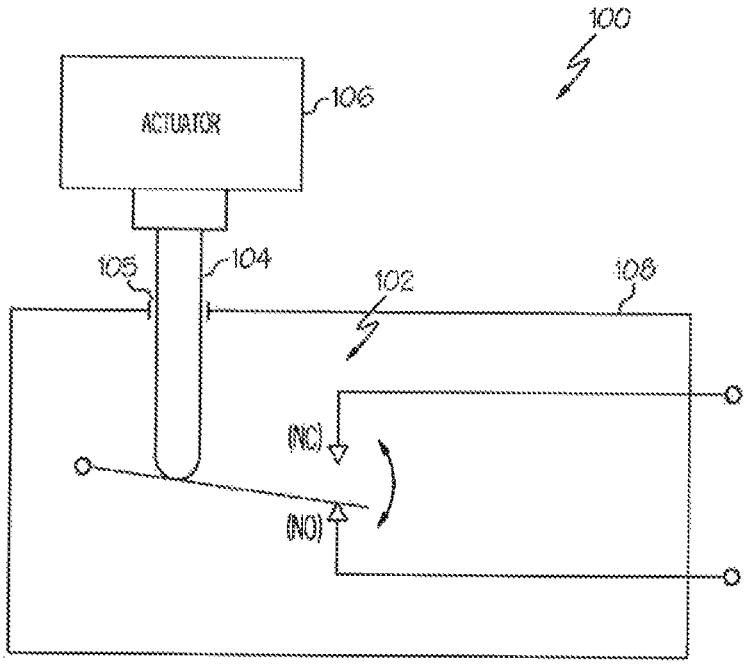
FIG. 1A and FIG. 1B depict simplified representations of one embodiment of a switch system.
Figure 1B:
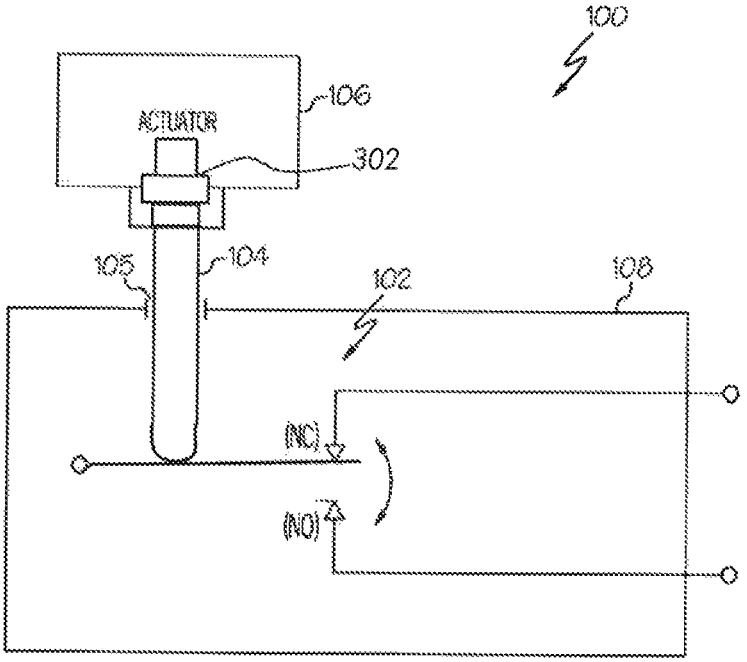
Figure 2:
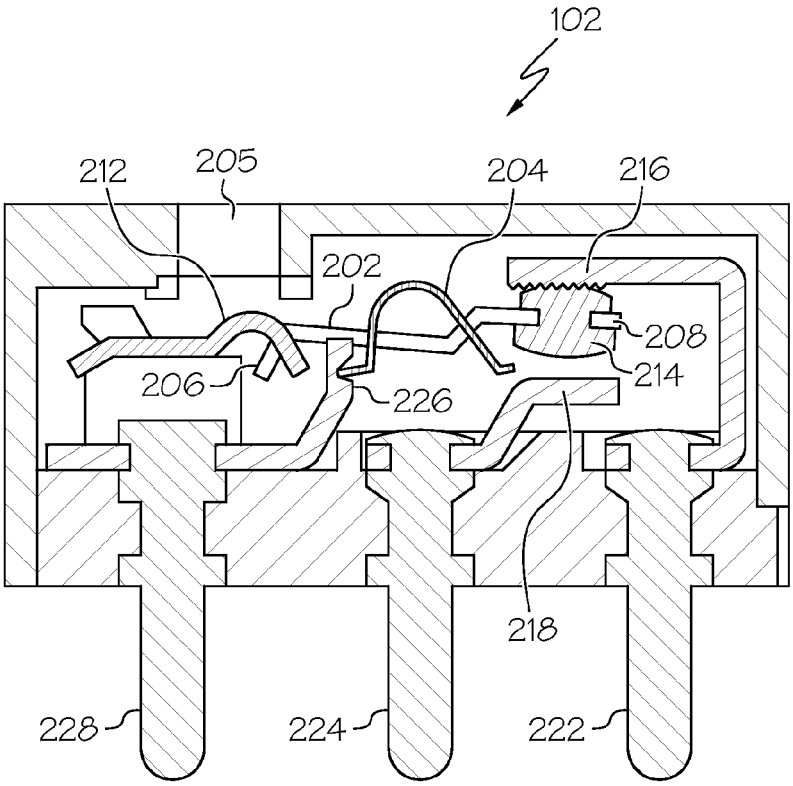
FIG. 2 depicts a cross section view of one embodiment of a snap action switch that may be used to implement the switch system of FIG. 1.

Referring to FIG. 1A and FIG. 1B, a simplified representation of one embodiment of a switch system 100 is depicted and includes a snap action switch 102, an operating plunger 104, and an actuator 106. The snap action switch 102 is disposed within a housing 108 and is configured to move, with snap-action, between a first switch position and a second switch position. In the depicted embodiment, the first switch position, which is the position depicted in FIG. 1A, is an open switch position, and the second switch position is a closed switch position as shown in FIG. 1B. It will be appreciated that in other embodiments the first switch position may be the closed switch position, and the second switch position may be the open switch position. It will additionally be appreciated that the snap action switch 102 may be variously configured and implemented. One particular non-limiting implementation is depicted in FIG. 2, and with reference thereto will now be described.

The depicted snap action switch 102 includes a leaf spring 202 and a preload spring 204. The leaf spring 202 is electrically conductive and includes a first end 206 and a second end 208. The first end 206 of the leaf spring 202 is coupled to a plunger interface 212, and the second end 208 of the leaf spring 202 has a contact interface 214 coupled thereto. The plunger interface 212 is mounted within the housing 108 and interfaces with the operating plunger 104. Though not depicted in FIG. 2, the operating plunger 104 extends through an opening 205 in the housing 108.

The contact interface 214 is electrically coupled to one or more normally-closed contacts 216 or to one or more normally-open contacts 218. The one or more normally-closed contacts 216 are electrically coupled to a first terminal 222. The one or more normally-open contacts 218 are spaced apart from the one or more normally-closed contacts 216 and are electrically coupled to a second terminal 224. The first and second terminals 222, 224 allow the normally-closed contacts 216 and the normally-open contacts 218, respectively, to be connected to external devices, circuits, or systems.

The preload spring 204, which is implemented as an electrically conductive curved spring, engages the leaf spring 202 and is coupled at one end to a fulcrum 226. The fulcrum 226 is electrically coupled to a common terminal 228, which may also be connected to external devices, circuits, or systems. The preload spring supplies a force to the leaf spring 202 that urges the second end 208 of the leaf spring 202 upward (from the perspective of FIG. 2), and thus causes the contact interface 214 to contact the normally-closed contact 216.

If, as will be described further below, a sufficient force is supplied to the plunger interface 212 that moves the first end of the leaf spring 202 downward (from the perspective of FIG. 2), the preload spring 204 will compress and the second end 208 of the leaf spring 202 will move, with snap-action, downwardly (from the perspective of FIG. 2). As a result, the contact interface 214 will contact the normally-open contact 218. The leaf spring 202 will remain in this position until the force is removed from the plunger interface 212.

Returning now to FIG. 1, it is seen that the operating plunger 104 extends through an opening 105 in the housing 108 and contacts the snap action switch 102. The operating plunger 104 is coupled to selectively receive an actuating force from the actuator 106 and is configured, upon receipt of the actuating force, to move the snap action switch 102 to, and retain the snap action switch 102 in, the first (or open) switch position. The operating plunger 104 is additionally configured, upon removal of the actuating force, to allow the snap action switch 102 to move from the first (or open) switch position back to the second (or closed) switch position.

The actuator 106 contacts the operating plunger 104 and is configured to selectively supply the actuating force to, and remove the actuating force from, the operating plunger 104. The actuator 106, which may be variously configured and implemented, is heated during normal operations of the switch system 100. Thus, during normal operations of the switch system 100 the actuator 106 may operate at temperatures in excess of 2000° F. It will be appreciated that the actuator 106 may itself generate heat or it may be heated by another device.

Regardless of how the actuator 106 is heated, because the actuator 106 is at a relatively high temperature during normal system operations, and because the plunger 104 contacts the snap action switch 102, the plunger 104 is configured to provide thermal protection for the snap action switch 102. More specifically, the plunger 104 is manufactured, at least partially, of a relatively high dielectric, low thermal conductivity material. The specific material used may vary, but is selected to withstand the relatively high temperatures of the actuator 106 and to maintain sufficiently high levels of electrical insulation to prevent potential damage to the snap action switch 102. Some non-limiting examples of suitable materials include various ceramics and various high-temperature grade thermoset phenolic materials. One suitable ceramic material, alumina, exhibits a thermal conductivity of 23 W/m-k per ASTM-C408, and a dielectric strength of 15 kV/mm per ASTM-D149. One suitable thermoset phenolic material, having the trade name RX640, exhibits a thermal conductivity of 0.55 W/m-k per ASTM standard C518, and a minimum dielectric strength of 11.8 kV/mm per ASTM standard D149.

Figure 3:
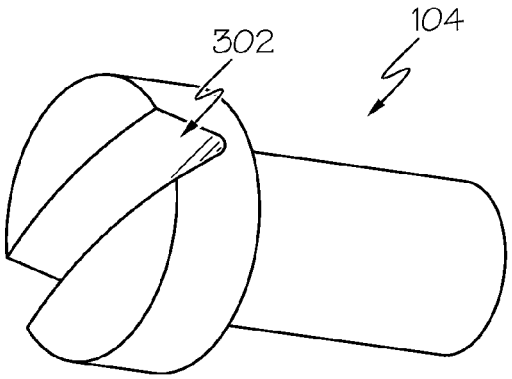
FIG. 3 depicts a plan view of one embodiment of an operating plunger that may be used to implement the system of FIG. 1.

In addition to being manufactured of a suitable material, the operating plunger 104 is additionally configured with a geometry that maintains proper contact and/or alignment with the actuator 106. More specifically, the plunger 104 includes an alignment feature that the actuator 106 mates with when the actuator 106 is supplying the actuating force to the operating plunger 104. It will be appreciated that the alignment feature may be variously configured and implemented, but in one particular embodiment, which is shown most clearly in FIG. 3, the alignment feature 302 is a groove.

Returning once again to FIG. 1, during normal operation of the switch system 100, the actuator 106 supplies an actuating force to the plunger 104, which causes the snap action switch 102 to move to the first (e.g., normally-open) switch position. As noted above, the actuator 106 is relatively hot. However, because the plunger 104 comprises the relatively low thermal conductivity, high dielectric material, the snap action switch 102 and plunger 104 are prevented from overheating. If a predetermined condition associated with the actuator 106, or the non-illustrated system to which the actuator is coupled, is attained, the actuator 106 will remove the actuating force from the plunger 104. As a result, the snap action switch 102 will move, with snap action, from the first (e.g., normally-open) switch position to the second (e.g., normally-closed) switch position.

In this document, relational terms such as first and second, and the like may be used solely to distinguish one entity or action from another entity or action without necessarily requiring or implying any actual such relationship or order between such entities or actions. Numerical ordinals such as "first," "second," "third," etc. simply denote different singles of a plurality and do not imply any order or sequence unless specifically defined by the claim language. The sequence of the text in any of the claims does not imply that process steps must be performed in a temporal or logical order according to such sequence unless it is specifically defined by the language of the claim. The process steps may be interchanged in any order without departing from the scope of the invention as long as such an interchange does not contradict the claim language and is not logically nonsensical.

Furthermore, depending on the context, words such as "connect" or "coupled to" used in describing a relationship between different elements do not imply that a direct physical connection must be made between these elements. For example, two elements may be connected to each other physically, electronically, logically, or in any other manner, through one or more additional elements.

While at least one exemplary embodiment has been presented in the foregoing detailed description of the invention, it should be appreciated that a vast number of variations exist. It should also be appreciated that the exemplary embodiment or exemplary embodiments are only examples, and are not intended to limit the scope, applicability, or configuration of the invention in any way. Rather, the foregoing detailed description will provide those skilled in the art with a convenient road map for implementing an exemplary embodiment of the invention. It being understood that various changes may be made in the function and arrangement of elements described in an exemplary embodiment without departing from the scope of the invention as set forth in the appended claims.

What is claimed is:

1. A switch system, comprising:

a snap action switch configured to move, with snap-action, from a first switch position to a second switch position;

a housing, wherein the snap action switch is disposed within the housing; and a heated actuator contacting an operating plunger and configured to selectively supply an actuating force to, and remove the actuating force from, the operating plunger, wherein the heated actuator is separate from the housing, wherein the operating plunger extends between the heated actuator and the housing, wherein the operating plunger extends into the housing through an opening in the housing and is disposed adjacent to the snap action switch within the housing, wherein the operating plunger is configured to selectively receive the actuating force, and upon receipt of the actuating force, to retain the snap action switch in the first switch position, wherein the operating plunger is further configured, upon removal of the actuating force, to allow the switch to move from the first switch position to the second switch position; and wherein the operating plunger comprises a dielectric material having a thermal conductivity of less than or equal to 23 W/m-k and a dielectric strength of less than or equal to 15 kV/mm per ASTM-D149.

2. The switch system of claim 1, wherein the dielectric material comprises a ceramic.

3. The switch system of claim 1, wherein the dielectric material comprises thermoset phenolic.

4. The switch system of claim 1, wherein:

the first switch position is an open position; and the second switch position is a closed position.

5. The switch system of claim 1, wherein:

the operating plunger comprises an alignment feature; and the heated actuator, when supplying the actuating force to the operating plunger, mates with the alignment feature.

6. The switch system of claim 1, wherein the plunger is configured to provide thermal protection for the snap action switch from the heated actuator.

7. The switch system of claim 1, wherein the switch comprises:

a preload spring; and an electrically conductive leaf spring coupled to the preload spring and configured, responsive to movement of the plunger to snap between the first switch position and the second switch position.

8. The switch system of claim 7, further comprising:

a normally-open contact disposed to be electrically connected to the leaf spring when the heated actuator is supplying the actuating force to the plunger;

a normally-closed contact spaced apart from the normally-open contact and disposed to be electrically connected to the leaf spring when the actuating force is removed from the plunger.

9. A switch system, comprising:

a housing;

a snap action switch disposed within the housing and configured to move, with snap-action, between a first switch position to a second switch position;

an operating plunger extending through an opening in the housing and contacting the snap action switch, the operating plunger coupled to selectively receive an actuating force and configured, upon receipt of the actuating force, to move the snap action switch to and retain the snap action switch in the first switch position, the operating plunger further configured, upon removal of the actuating force, to allow the switch to move from the first switch position to the second switch position; and a heated actuator contacting the operating plunger and configured to selectively supply the actuating force to, and remove the actuating force from, the operating plunger, wherein the heated actuator is outside of the housing, wherein the operating plunger comprises a dielectric material having a thermal conductivity of less than or equal to 23 W/m-k and a dielectric strength of less than or equal to 15 kV/mm per ASTM-D149.

10. The switch system of claim 9, wherein the dielectric material comprises a ceramic.

11. The switch system of claim 9, wherein the dielectric material comprises thermoset phenolic.

12. The switch system of claim 9, wherein:

the first switch position is an open position; and the second switch position is a closed position.

13. The switch system of claim 9, wherein:

the operating plunger comprises an alignment feature; and the heated actuator, when supplying the actuating force to the operating plunger, mates with the alignment feature.

14. The switch system of claim 9, wherein the switch comprises:

a preload spring; and a leaf spring coupled to the preload spring and responsive to movement of the plunger to snap between the first switch position and the second switch position.

15. The switch system of claim 14, further comprising:

a normally-open contact disposed to be electrically connected to the leaf spring when the heated actuator is supplying the actuating force to the plunger;

a normally-closed contact spaced apart from the normally-open contact and disposed to be electrically connected to the leaf spring when the actuating force is removed from the plunger.

16. A switch system, comprising:

a snap action switch disposed within a housing and configured to move, with snap-action, between an open switch position to a closed switch position;

an operating plunger extending through an opening in the housing and contacting the snap action switch, the operating plunger coupled to selectively receive an actuating force and configured, upon receipt of the actuating force, to move the snap action switch to and retain the snap action switch in the open switch position, the operating plunger further configured, upon removal of the actuating force, to allow the switch to move from the open switch position to the closed switch position; and a heated actuator contacting the operating plunger and configured to selectively supply the actuating force to, and remove the actuating force from, the operating plunger, wherein the operating plunger comprises a dielectric material having a thermal conductivity of less than or equal to 23 W/m-k and a dielectric strength of less than or equal to 15 kV/mm per ASTM-D149.

17. The switch system of claim 16, wherein the dielectric material comprises a ceramic.

18. The switch system of claim 16, wherein the dielectric material comprises a thermoset phenolic.

19. The switch system of claim 16, wherein:

the operating plunger comprises an alignment feature; and the heated actuator, when supplying the actuating force to the operating plunger, mates with the alignment feature.

20. The switch system of claim 16, wherein the switch comprises:

a preload spring;

a leaf spring coupled to the preload spring and responsive to movement of the plunger to snap between the first switch position and the second switch position;

a normally-open contact disposed to be electrically connected to the leaf spring when the heated actuator is supplying the actuating force to the plunger;

a normally-closed contact spaced apart from the normally-open contact and disposed to be electrically connected to the leaf spring when the actuating force is removed from the plunger.

* * * * *